US009155976B1

(12) United States Patent
Mosquera

(10) Patent No.: US 9,155,976 B1
(45) Date of Patent: Oct. 13, 2015

(54) BUILDING SYSTEM TOY

(71) Applicant: Gustavo Mosquera, Lake Geneva, WI (US)

(72) Inventor: Gustavo Mosquera, Lake Geneva, WI (US)

( * ) Notice: Subject to any disclaimer, the term of this patent is extended or adjusted under 35 U.S.C. 154(b) by 138 days.

(21) Appl. No.: 14/027,496

(22) Filed: Sep. 16, 2013

(51) Int. Cl.
*A63H 33/04* (2006.01)
*A63H 33/08* (2006.01)

(52) U.S. Cl.
CPC ..... *A63H 33/08* (2013.01)

(58) Field of Classification Search
CPC ..... A63H 33/04; A63H 33/06; A63H 33/08; A63H 33/086; A63H 33/088; A63H 33/108
USPC ..... 446/120, 124, 125, 126, 128
See application file for complete search history.

(56) References Cited

U.S. PATENT DOCUMENTS 2,406,759 A * 9/1946 Glukes ..... 446/127
2,983,014 A * 5/1961 Greenwood ..... 24/545
3,310,906 A * 3/1967 Glukes ..... 446/95
4,372,705 A * 2/1983 Atkinson ..... 405/19
5,137,485 A 8/1992 Penner
5,653,621 A 8/1997 Yao
6,552,270 B1 * 4/2003 Heacox ..... 174/71 R

* cited by examiner

*Primary Examiner* — Vishu Mendiratta
(74) *Attorney, Agent, or Firm* — Donald J. Ersler

(57) ABSTRACT

A building system toy preferably includes a double female connector, a male-female connector, a male connector, a right angle connector, a split male-female connector, a split opposing male-female connector, an angle connector and a double angle connector. The double female connector includes a base female connector and four female connection rings. The male-female connector includes the base female connector and four cylinders. The male connector includes a star base and four small cylinders. The right angle connector includes a base, a small cylinder, a first cylinder and a second cylinder. The split male-female connector and the split opposing male-female connector both include the base female connector, two female connection rings and two cylinders. An angle connector includes a first connection portion and a second connector portion. The double angle connector includes a first connector portion, a second connector portion and a third connector.

8 Claims, 13 Drawing Sheets

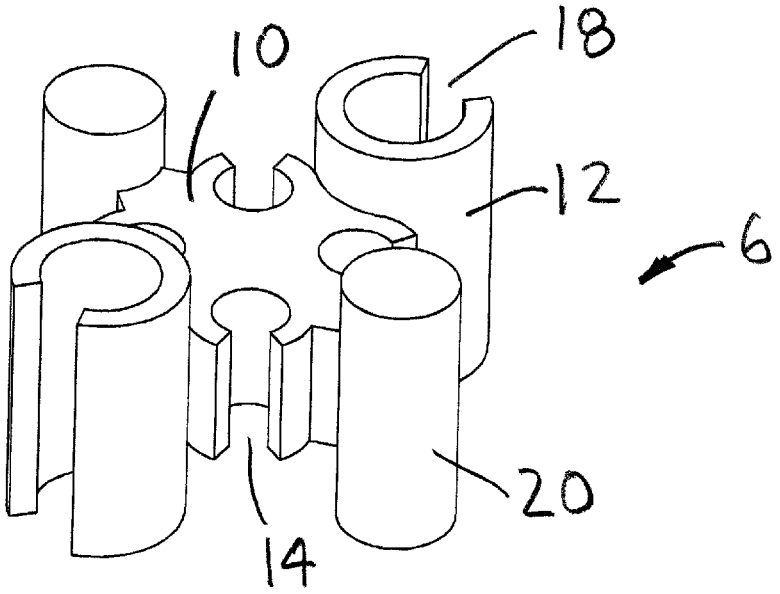
FIG, 12
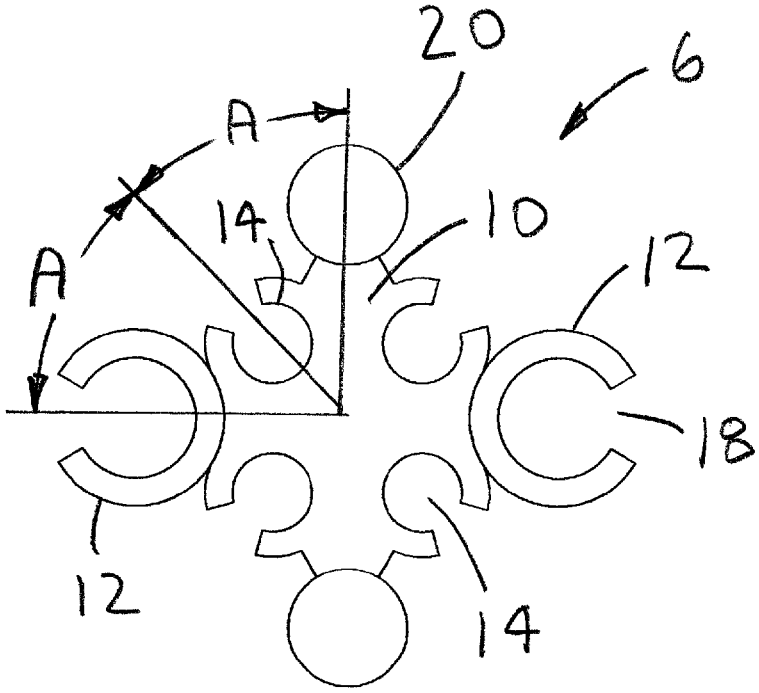
FIG, 13

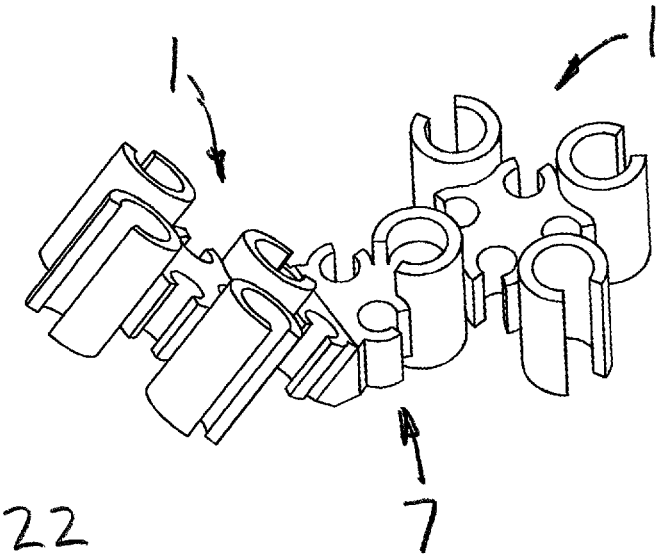
FIG, 22
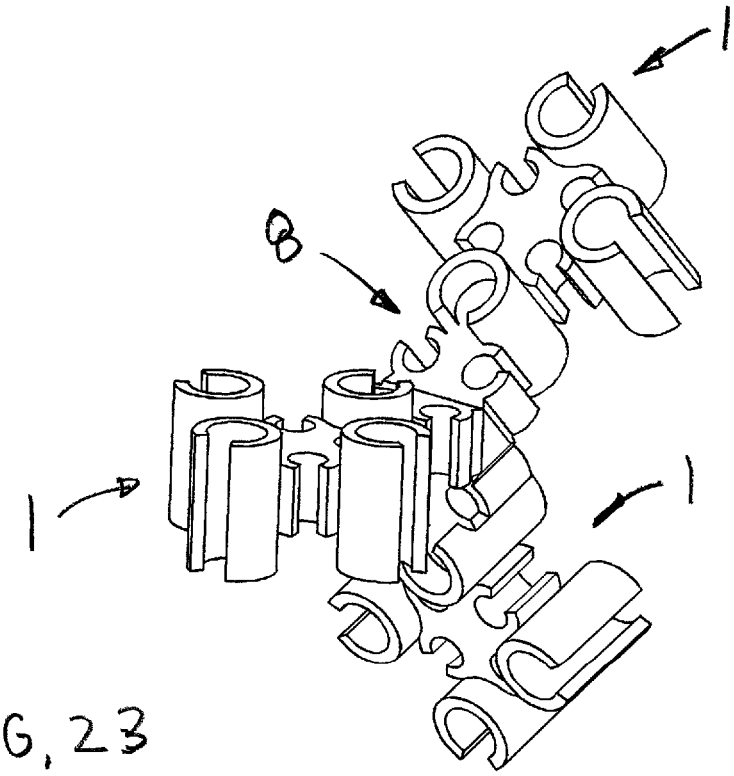
FIG, 23

BUILDING SYSTEM TOY

BACKGROUND OF THE INVENTION

1. Field of the Invention

The present invention relates generally to toys and more specifically to a building system toy, which includes a variety of interlocking pieces for constructing an object.

2. Discussion of the Prior Art

U.S. Pat. No. 2,406,759 to Glukes discloses a construction toy. U.S. Pat. No. 5,137,485 to Penner discloses a toy construction set with improved radial and axial connectability and expandability. U.S. Pat. No. 5,653,621 to Yao discloses a toy building block puzzle.

Accordingly, there is a clearly felt need in the art for a building system toy, which includes a variety of interlocking pieces for constructing an object.

SUMMARY OF THE INVENTION

The present invention provides a building system toy, which includes a variety of interlocking pieces for constructing an object. The building system toy preferably includes a double female connector, a male-female connector, a male connector, a right angle connector, a split male-female connector, a split opposing male-female connector, an angle connector and a double angle connector. The double female connector includes a base female connector and four female connection rings. The base female connector includes four equally spaced small female cavities. The four female connection rings extend from an outer perimeter of the base female connector. Each female ring is oriented at a 45 degree angle from each small female cavity. The male-female connector includes the base female connector and four cylinders. The four cylinders extend from an outer perimeter of the base female connector. Each cylinder is preferably oriented at a 45 degree angle from each small female cavity.

The male connector includes a star base and four small cylinders. The star base includes four equally spaced star projections. Each star projection is terminated with a single small cylinder. The right angle connector includes a base, a small cylinder, a first cylinder and a second cylinder. The base includes a first edge, a second edge and a star projection. The first edge is substantially perpendicular to the second edge. The star projection is located between the first and second edge. The first cylinder extends from the first edge and the second cylinder extends from the second edge. The small cylinder extends from the star projection. An axis of the small cylinder is perpendicular to the axis of the first and second cylinders.

The split male-female connector includes a base female connector, two female connection rings and two cylinders. The base female connector includes four equally spaced small female cavities. The two female connection rings and the two cylinders are positioned on an opposing sides of the base female connector. Each cylinder is oriented at a 45 degree angle from each small female cavity. The split opposing male-female connector includes a base female connector, two female connection rings and two cylinders. The base female connector includes four equally spaced small female cavities. The two female connection rings are positioned on opposing sides of the base female connector and the two cylinders are positioned on opposing sides of the base female connector. The two cylinders are position perpendicular to the two female connection rings.

An angle connector includes a first connection portion and a second connector portion. Each connector portion includes a base member and a cylinder. Two small female cavities are formed through opposing sides of the base member. The cylinder extends outward from the base member. The first and second connector portions are positioned at an obtuse angle to each other. The double angle connector includes a first connector portion, a second connector portion and a third connector portion. Each connector portion includes a base member and a cylinder. Two small female cavities are formed through opposing sides of the base member. The cylinder extends outward from the base member. The first, second and third connector portions are positioned at obtuse angles equal distant from each other.

Accordingly, it is an object of the present invention to provide a building system toy, which includes a variety of interlocking pieces for constructing an object.

These and additional objects, advantages, features and benefits of the present invention will become apparent from the following specification.

BRIEF DESCRIPTION OF THE DRAWINGS

FIG. 12 is a perspective view of a split opposing male-female connector of a building system toy in accordance with the present invention.

FIG. 13 is a top view of a split opposing male-female connector of a building system toy in accordance with the present invention.

FIG. 22 is a perspective view of two double female connectors are assembled to each other with an angle connector of a building system toy in accordance with the present invention.

FIG. 23 is a perspective view of three double female connectors are assembled to each other with a double angle connector of a building system toy in accordance with the present invention.

DETAILED DESCRIPTION OF THE PREFERRED EMBODIMENTS

Figure 1:
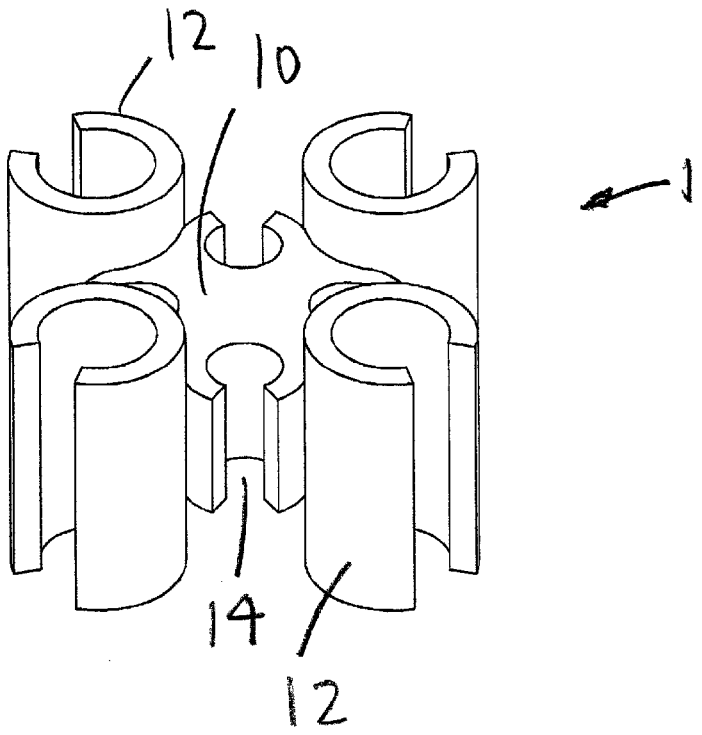
FIG. 1 is a perspective view of a double female connector of a building system toy in accordance with the present invention.
Figure 2:
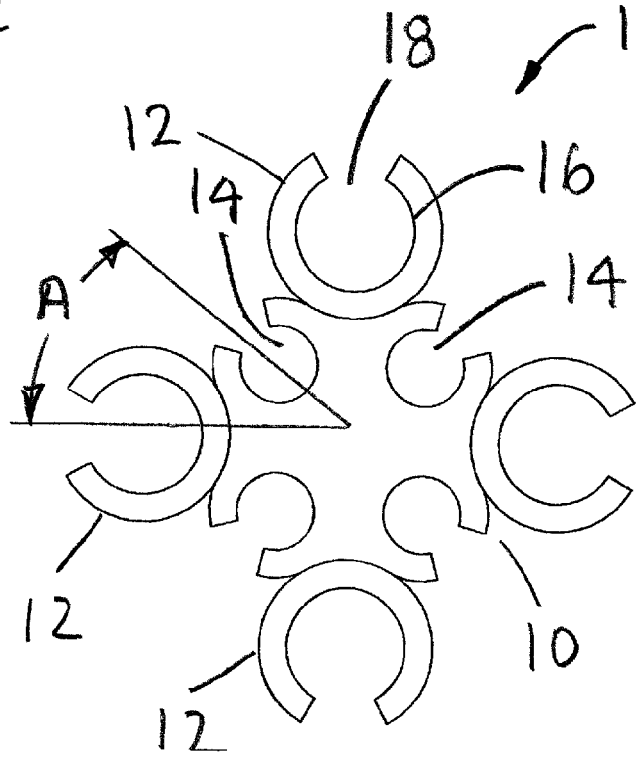
FIG. 2 is a top view of a double female connector of a building system toy in accordance with the present invention.

With reference now to the drawings, and particularly to FIG. 1, there is shown a perspective view of a double female connector 1 of a building system toy. With reference to FIGS. 2-17, the building system toy preferably includes the double female connector 1, a male-female connector 2, a male connector 3, a right angle connector 4, a split male-female connector 5, a split opposing male-female connector 6, an angle connector 7 and a double angle connector 8. The double female connector 1 includes a base female connector 10 and four female connection rings 12. The base female connector 10 includes four equally spaced small female cavities 14. Each small female cavity 14 is preferably round. The four female connection rings 12 extend from an outer perimeter of the base female connector 10. An inner perimeter 16 of each female connector ring 12 is preferably round. Each female ring 12 is oriented at an angle "A" from each small female cavity 14. The angle "A" is preferably 45 degrees. The length of the female connection ring 12 extends above and below the base female connector 10. With reference to FIGS. 18-23, a lengthwise slit 18 is formed through each female connection ring 12 to provide clearance for the male-female connector 2, the right angle connector 4, the split male-female connector 5, the split opposing male-female connector 6, the angle connector 7 or the double angle connector 8.

Figure 3:
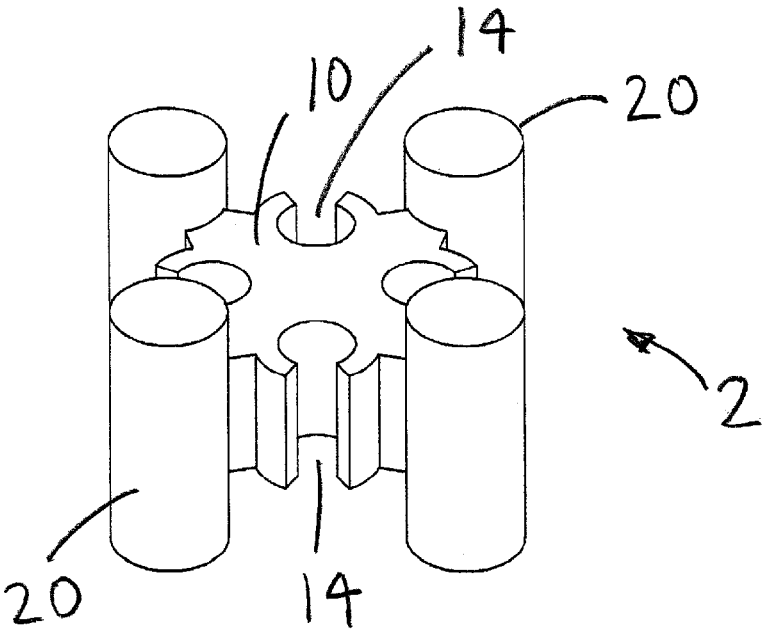
FIG. 3 is a perspective view of a male-female connector of a building system toy in accordance with the present invention.
Figure 4:
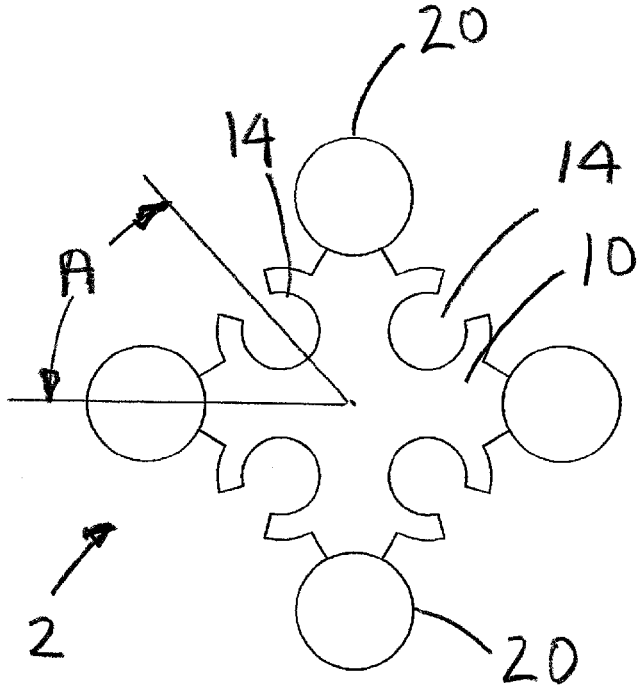
FIG. 4 is a top view of a male-female connector of a building system toy in accordance with the present invention.

With reference to FIGS. 3-4, the male-female connector 2 includes the base female connector 10 and four cylinders 20. The base female connector 10. The four cylinders 20 extend from an outer perimeter of the base female connector 10. Each cylinder 20 is oriented at an angle "A" from each small female cavity 14. The angle "A" is preferably 45 degrees. An outer perimeter of each cylinder 20 is preferably round. The four cylinders 20 are sized to be slidably received by the four inner perimeters 16 of the four female rings 12. A length of the four cylinders 20 preferably extends above and below the base female connector 10.

Figure 5:
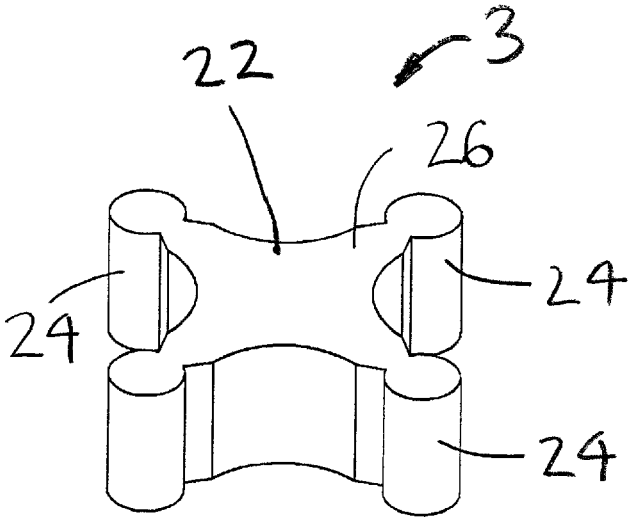
FIG. 5 is a perspective view of a male connector of a building system toy in accordance with the present invention.
Figure 6:
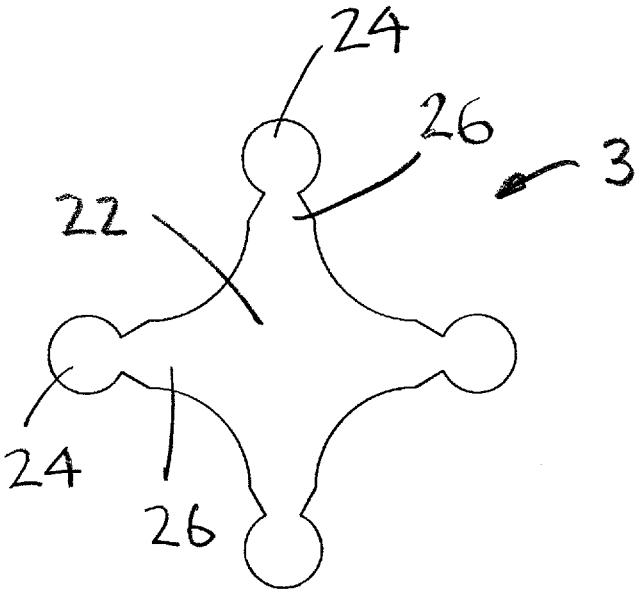
FIG. 6 is a top view of a male connector of a building system toy in accordance with the present invention.
Figure 7:
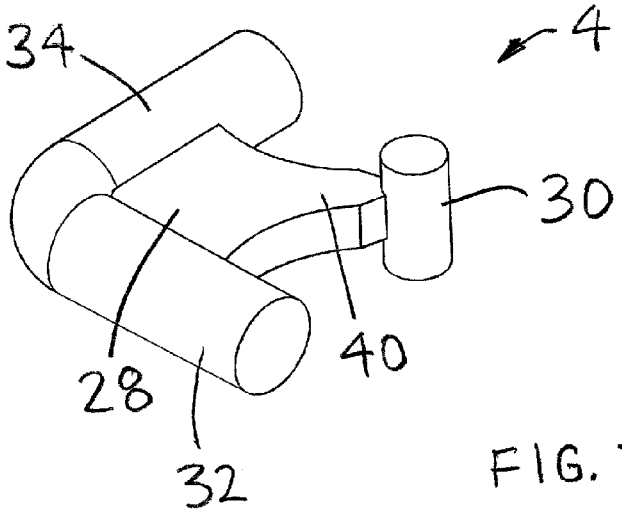
FIG. 7 is a perspective view of a right angle connector of a building system toy in accordance with the present invention.
Figure 8:
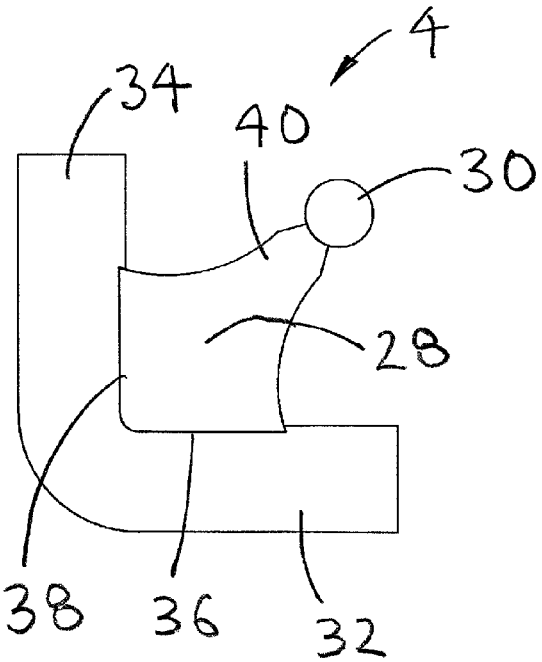
FIG. 8 is a top view of a right angle connector of a building system toy in accordance with the present invention.
Figure 9:
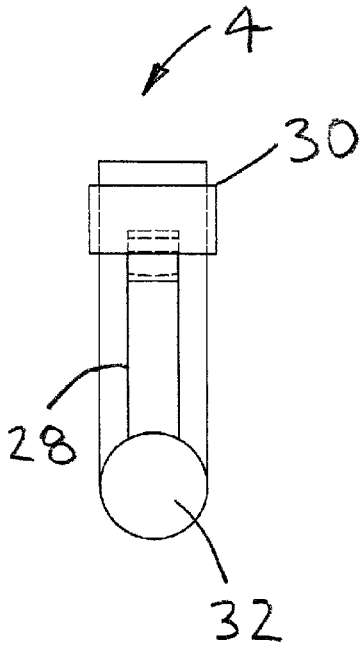
FIG. 9 is an end view of a right angle connector of a building system toy in accordance with the present invention.

With reference to FIGS. 5-6, the male connector 3 includes a star base 22 and four small cylinders 24. The star base 22 includes four equally spaced star projections 26. Each star projection 26 is terminated with a single small cylinder 24. Each small cylinder 24 preferably has a round outer perimeter. Each small cylinder 24 is sized to be received by the four small female cavities 14. With reference to FIGS. 7-9, the right angle connector 4 includes a base 28, a small cylinder 30, a first cylinder 32 and a second cylinder 34. The base 28 includes a first edge 36, a second edge 38 and a star projection 40. The first edge 36 is substantially perpendicular to the second edge 38. The star projection 40 extends from the base 28, between the first and second edges 36, 38. The first cylinder 32 extends from the first edge 36 and the second cylinder 34 extends from the second edge 38. The small cylinder 30 extends from an end of the star projection 40. An axis of the small cylinder 30 is perpendicular to an axis of the first and second cylinders 32, 34. A diameter of the first and second cylinders 30, 32 preferably extends above and below the base 28. A length of the small cylinder 30 preferably extends above and below the first and second cylinders 30, 32. The small cylinder 30 is sized to be received by the four small female cavities 14. The first and second cylinders 30, 32 are sized to be received by the four female connection rings 12.

Figure 10:
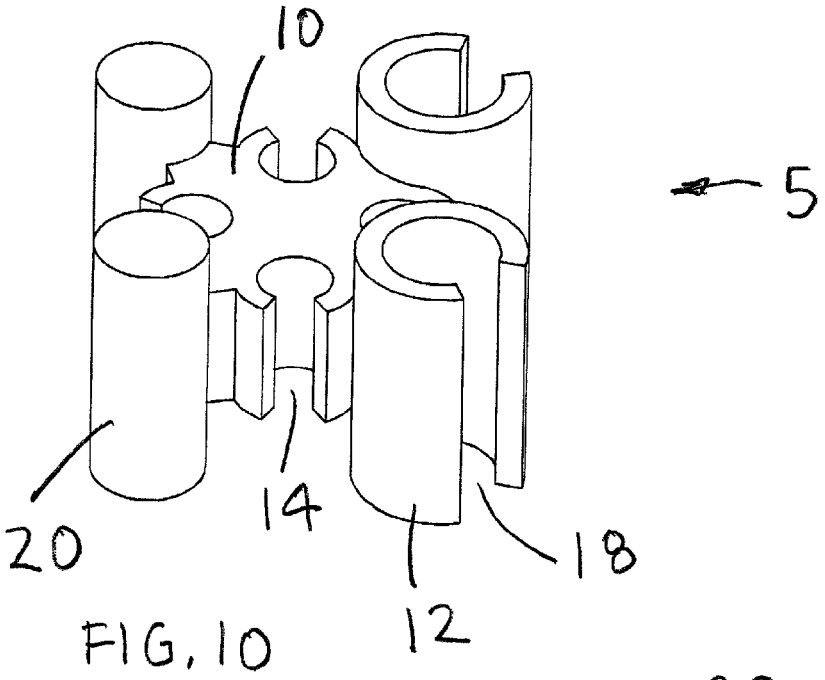
FIG. 10 is a perspective view of a split male-female connector of a building system toy in accordance with the present invention.
Figure 11:
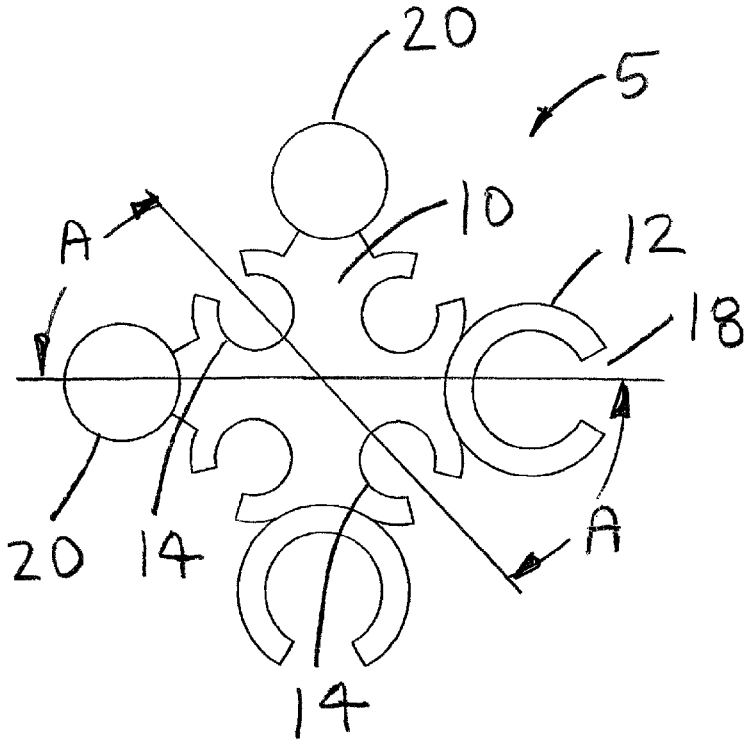
FIG. 11 is a top view of a split male-female connector of a building system toy in accordance with the present invention.

With reference to FIGS. 10-11, the split male-female connector 5 includes the base female connector 10, two female connection rings 12 and two cylinders 20. The two female connection rings 12 and the two cylinders 20 extend from opposing sides of the base female connector 10. Each female ring 12 is oriented at an angle "A" from the small female cavity 14. Each cylinder 20 is oriented at an angle "A" from the small female cavity 14. The angle "A" is preferably 45 degrees. The length of the two female connection ring 12 and the two cylinders 20 extend above and below the base female connector 10.

With reference to FIGS. 12-13, the split opposing male-female connector 6 includes the base female connector 10, two female connection rings 12 and two cylinders 20. The two female connection rings 12 extend from opposing sides of the base female connector 10 and the two cylinders 20 extend from opposing sides the base female connector 10. Each female ring 12 is oriented at an angle "A" from the small female cavity 14. Each cylinder 20 is oriented at an angle "A" from the small female cavity 14. The angle "A" is preferably 45 degrees. The length of the two female connection ring 12 and the two cylinders 20 extend above and below the base female connector 10.

Figure 14:
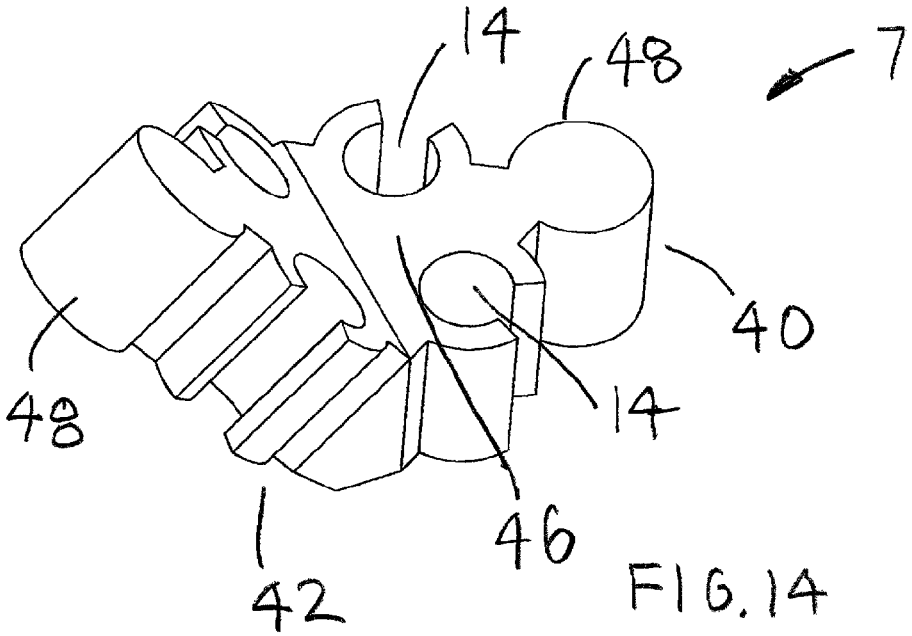
FIG. 14 is a perspective view of an angle connector of a building system toy in accordance with the present invention.
Figure 15:
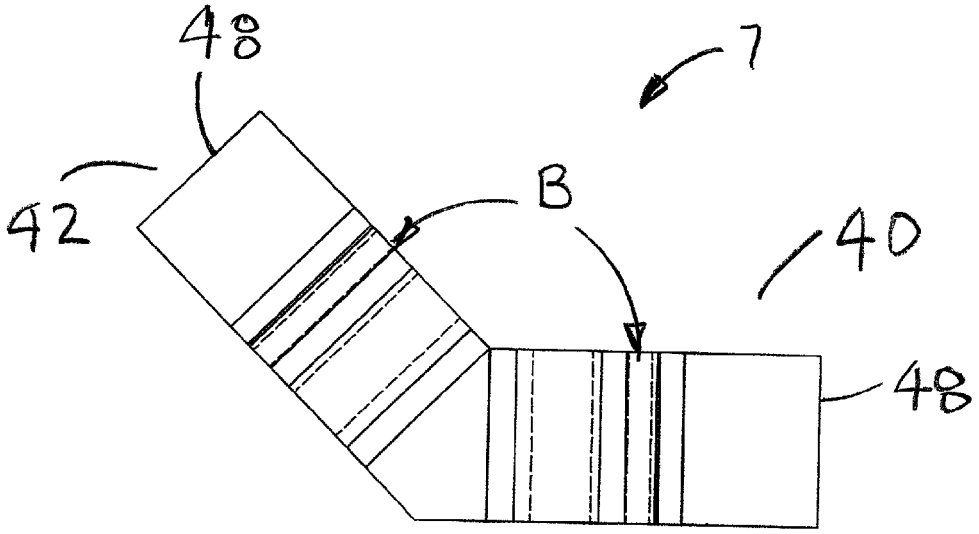
FIG. 15 is a side view of an angle connector of a building system toy in accordance with the present invention.

With reference to FIGS. 14-15, the angle connector 7 includes a first connection portion 42 and a second connector portion 44. Each connector portion 40, 42 includes a base member 46 and a cylinder 48. Two small female cavities 14 are formed through opposing sides of the base member 46. The cylinder 48 extends outward from the base member 46. The first and second connector portions 40, 42 are positioned at an obtuse angle "B" from each other. Angle "B" is preferably 120 degrees. The cylinder 48 is sized to be received by the female connection ring 12.

Figure 16:
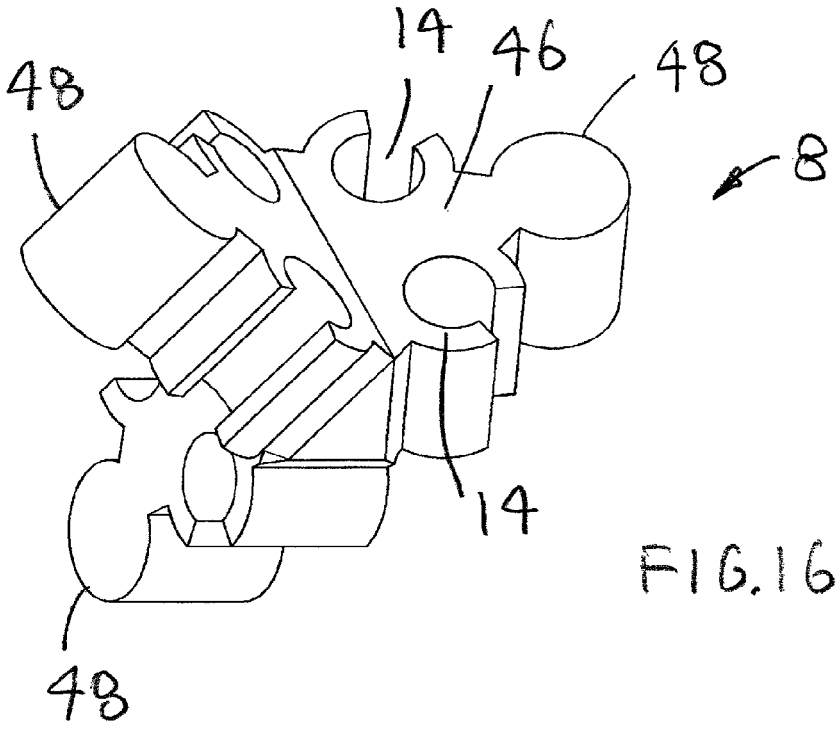
FIG. 16 is a perspective view of a double angle connector of a building system toy in accordance with the present invention.
Figure 17:
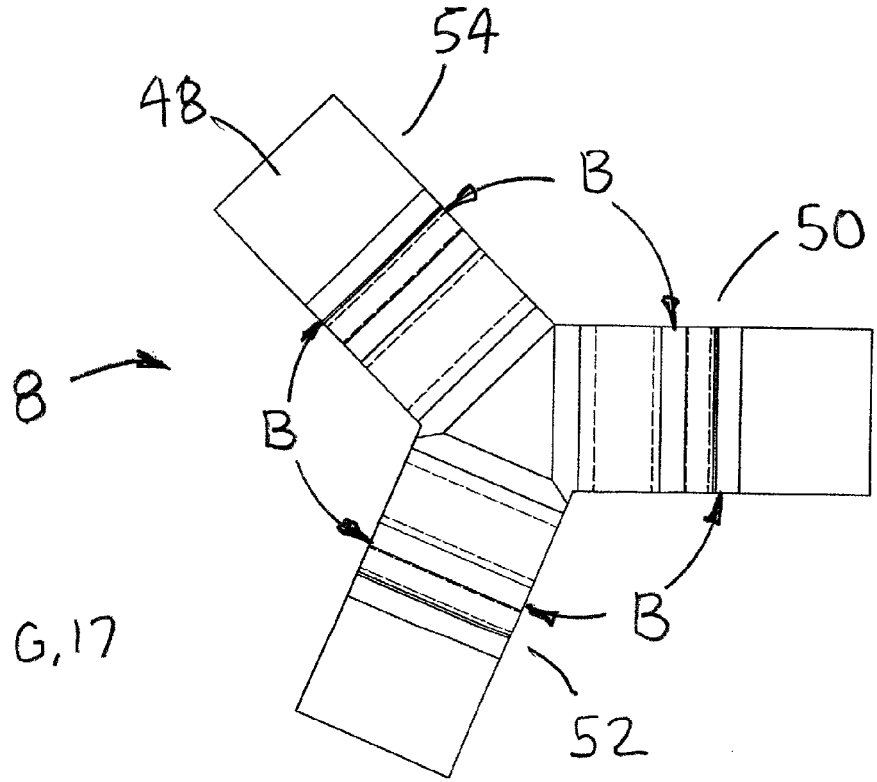
FIG. 17 is a side view of a double angle connector of a building system toy in accordance with the present invention.

With reference to FIGS. 16-17, the double angle connector 8 includes a first connector portion 50, a second connector portion 52 and a third connector portion 54. Each connector portion 50, 52, 54 includes the base member 46 and the cylinder 48. The first, second and third connector portions 50, 52, 54 are preferably positioned at an obtuse angle "B" from each other. Angle "B" is 120 degrees.

Figure 18:
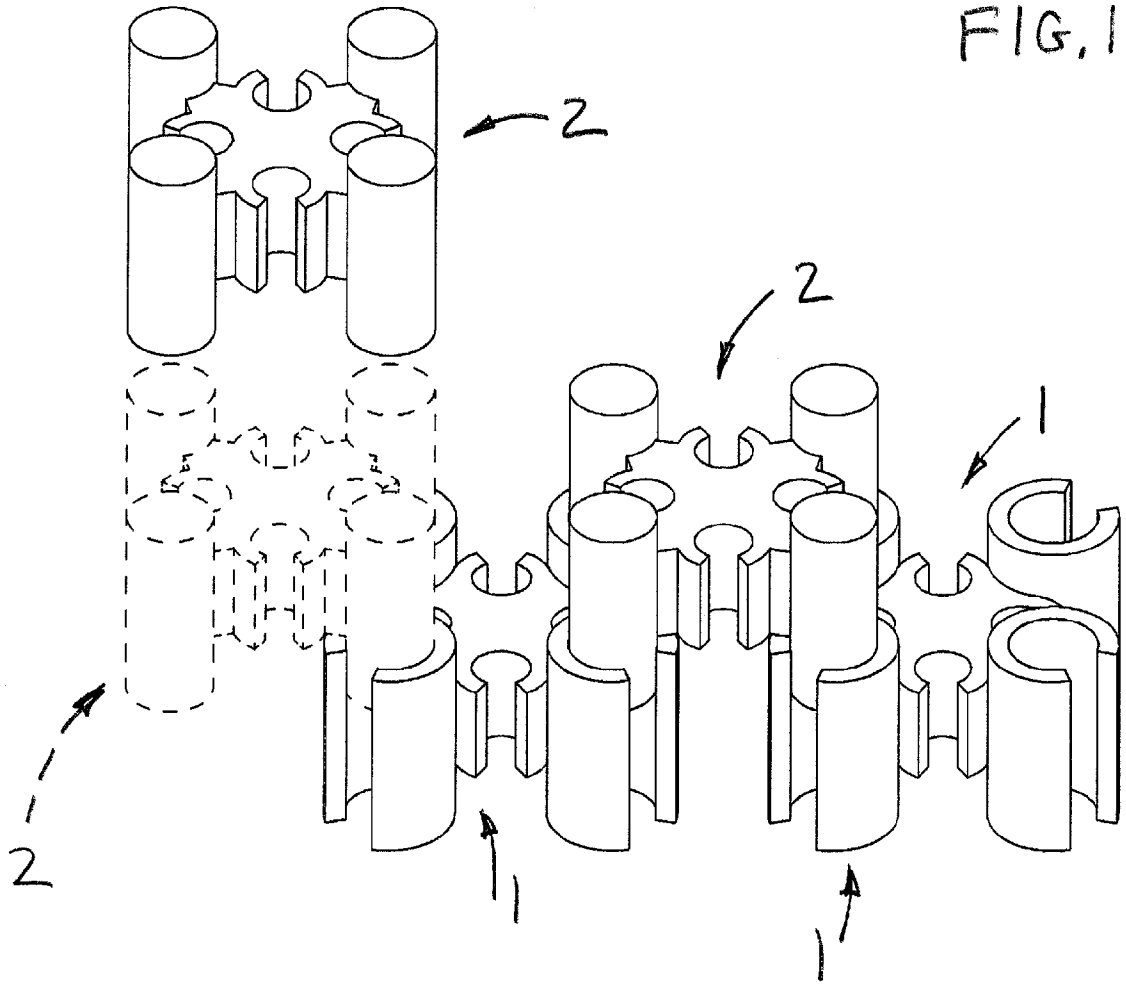
FIG. 18 is a perspective view of a plurality of double female connectors being assembled to a plurality of male-female connectors of a building system toy in accordance with the present invention.
Figure 19:
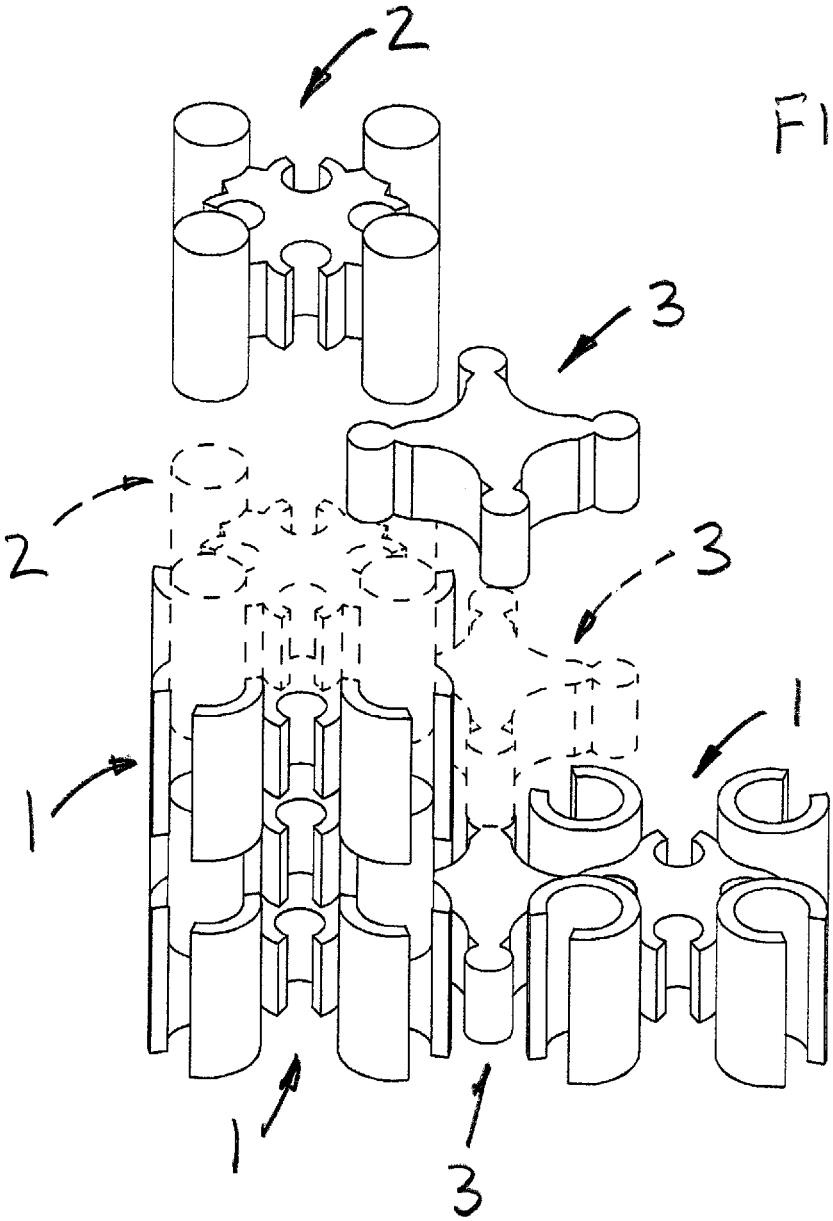
FIG. 19 is a perspective view of a plurality of double female connectors, a plurality male-female connectors and a plurality of male connectors being assembled to each other of a building system toy in accordance with the present invention.
Figure 20:
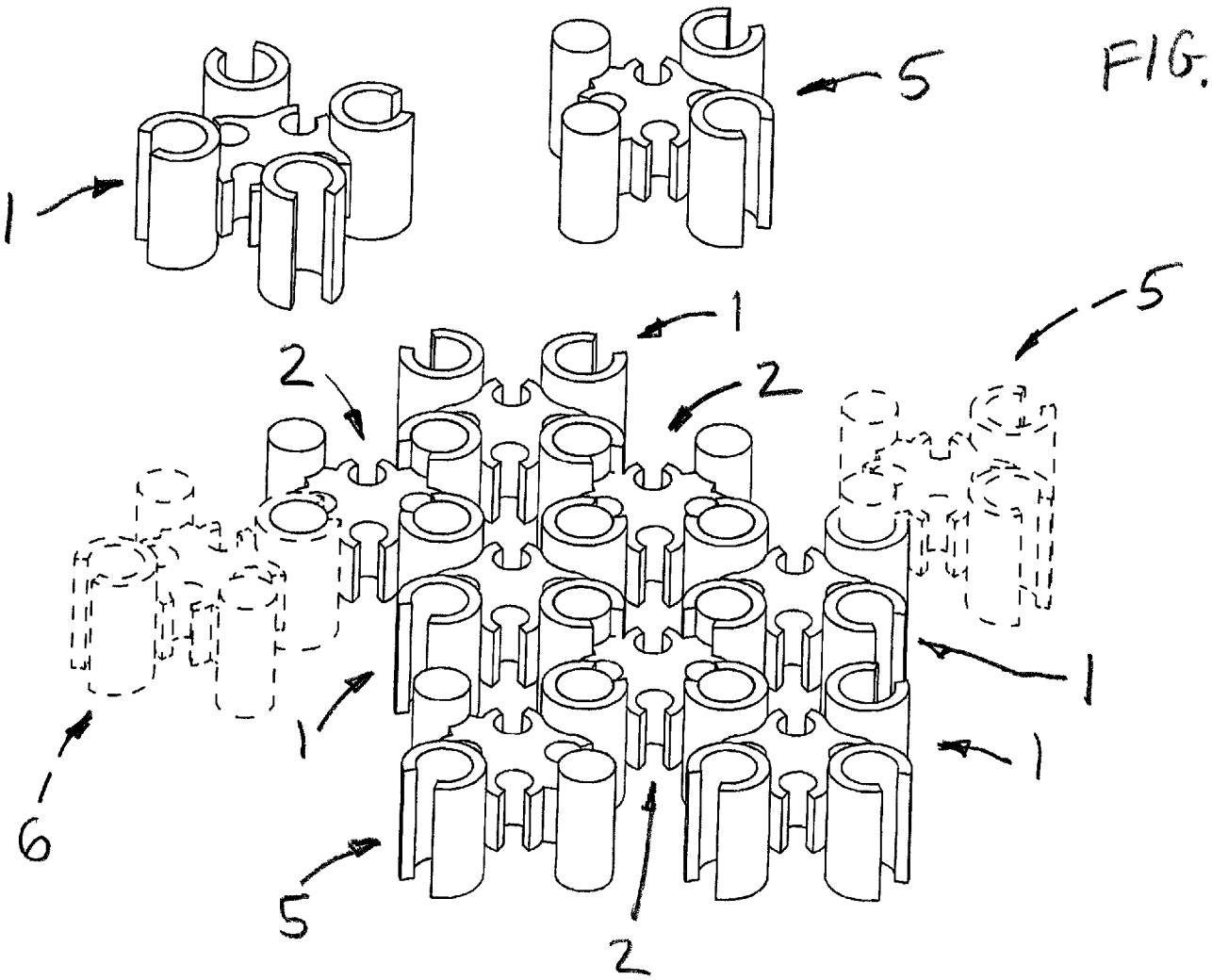
FIG. 20 is a perspective view of a plurality of double female connectors, a plurality of male-female connectors, a plurality of split male-female connectors and a split opposing male-female connectors being assembled to each other of a building system toy in accordance with the present invention.

With reference to FIG. 18, a plurality of double female connectors 1 are being assembled to a plurality of male-female connectors 2. With reference to FIG. 19, a plurality of double female connectors 1, a plurality male-female connectors 2 and a plurality of male connectors 3 are being assembled to each other. With reference to FIG. 20, a plurality of double female 1 connectors, a plurality of male-female connectors 2, a plurality of split male-female connectors 5 and a split opposing male-female connector are being assembled to each other.

Figure 21:
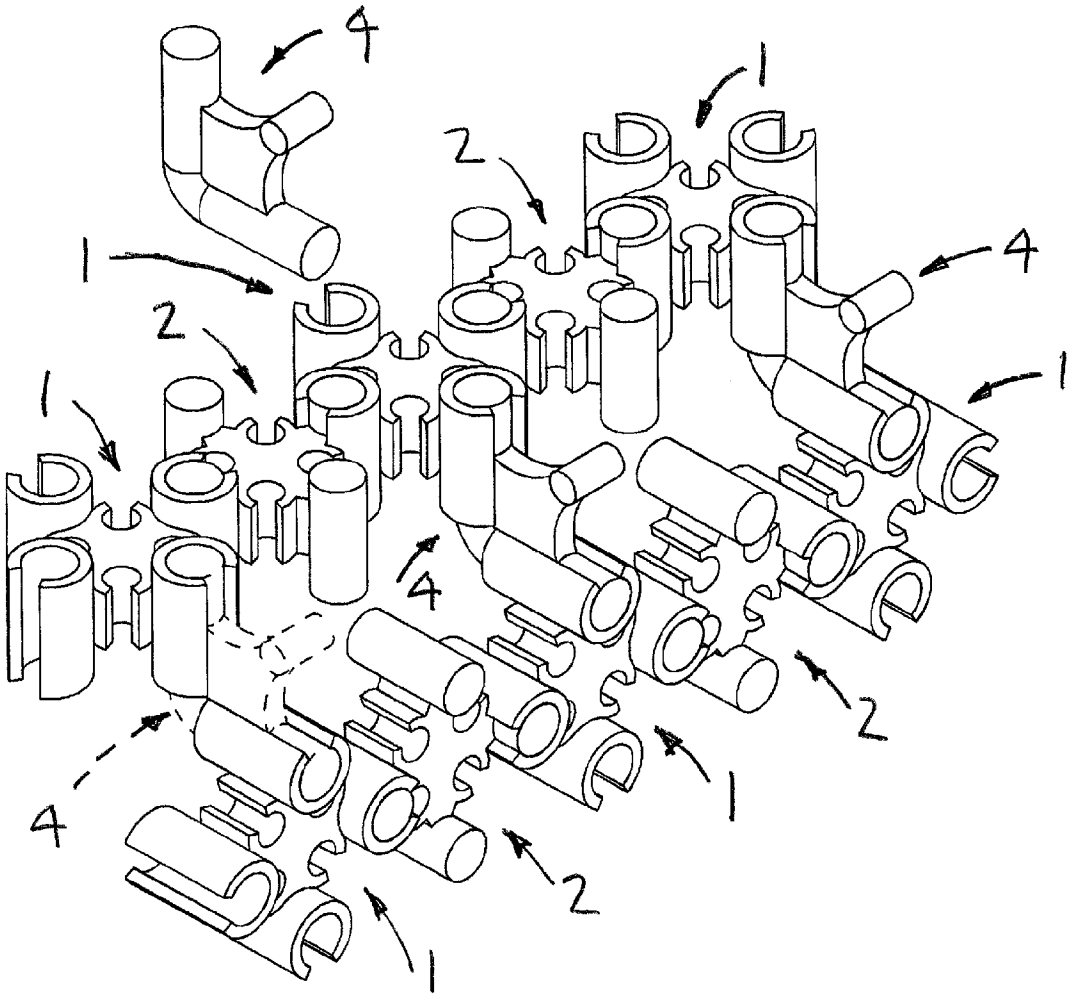
FIG. 21 is a perspective view of a plurality of double female connectors, a plurality of male-female connectors and a plurality of right angle connectors being assembled to each other of a building system toy in accordance with the present invention.

With reference to FIG. 21, a plurality of double female connectors 1, a plurality of male-female connectors 2 and a plurality of right angle connectors 4 are being assembled to each other. With reference to FIG. 22, two double female connectors 2 are assembled to an angle connector 7. With reference to FIG. 23, three double female connectors 1 are assembled to a double angle connector 8.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A building system toy comprising:

a base female connector includes a female base and four small female cavities, said four small female cavities are formed through a height of said female base, a slit is formed through an outer side wall of said female base into each one of said four small female cavities, said four small female cavities have a round shape;

four female connector rings extend outward from said female base, each one of said four female connector rings is disposed at substantially 45 degrees from each one of said four small female cavities, said four female connector rings have an outer ring perimeter, a slit is formed through a sidewall of each one of said four female connector rings at substantially said outer ring perimeter, a height of said four female connector rings extending above and below said base female connector; and a male connector includes a star base and four small cylinders, said star base includes four star projections, said four projections are terminated with said four small cylinders, each one of said four small cylinders is sized to be received by one of said four small female cavities.

2. The building system toy of claim 1 wherein:

each one of said four female connector rings include a substantially round inner perimeter.

3. The building system toy of claim 1 wherein:

said four small female cavities are equally spaced from each other.

4. A building system toy comprising:

a base female connector includes a female base and four small female cavities, said four small female cavities are formed through a height of said female base, a slit is formed through an outer side wall of said female base into each one of said four small female cavities, said four small female cavities have a round shape;

four cylinders extend outward from said female base, said four cylinders include a substantially round cross section, each one of said four cylinders is disposed at substantially 45 degrees from each one of said four small female cavities, a height of said four cylinders extending above and below said base female connector; and a male connector includes a star base and four small cylinders, said star base includes four star projections, said four projections are terminated with said four small cylinders, each one of said four small cylinders is sized to be received by one of said four small female cavities.

5. A building system toy comprising:

a base female connector includes a female base and four small female cavities, said four small female cavities are formed through a height of said female base, a slit is formed through an outer side wall of said female base into each one of said four small female cavities, said four small female cavities have a round shape; and two female connector rings extend outward from said female base, two cylinders extend outward from said female base, each one of said two female connector rings and said two cylinders are disposed at substantially 45 degrees from each one of said four small female cavities, said two female connector rings have an outer ring perimeter, a slit is formed through a sidewall of each one of said two female connector rings at substantially said outer ring perimeter, each one of said two female connector rings include a substantially round inner perimeter, a height of said two female connector rings and said two cylinders extending above and below said base female connector.

6. The building system toy of claim 5, further comprising:

a male connector includes a star base and four small cylinders, said star base includes four equally spaced star projections, said four projections are terminated with said four small cylinders, each one of said four small cylinders is sized to be received by one of said four small female cavities.

7. The building system toy of claim 5 wherein:

said two female connector rings opposing each other on opposing sides of said connector, said two cylinders opposing each other on opposing sides of said base female connector.

8. The building system toy of claim 5 wherein:

one of said two female connector rings opposing one of said two cylinders on opposing sides of said base female connector, the other one of two female connector rings opposing the other one of said two cylinders on opposing sides of said base female connector.

* * * * *